United States Patent [19]

Susukida et al.

[11] Patent Number: 4,474,733

[45] Date of Patent: Oct. 2, 1984

[54] HEAT RESISTANT NICKEL BASE ALLOY EXCELLENT IN WORKABILITY AND HIGH TEMPERATURE STRENGTH PROPERTIES

[75] Inventors: Hiroshi Susukida; Ichiro Tsuji; Hisataka Kawai; Hitomi Itoh, all of Takasago; Makoto Yuge, Ohmiya; Toshiki Takeiri, Ohmiya; Kensho Sahira, Ohmiya; Toshio Kojima, Ohmiya, all of Japan

[73] Assignees: Mitsubishi Jukogyo Kabushiki Kaisha; Mitsubishi Kinzoku Kabushiki Kaisha, both of Tokyo, Japan

[21] Appl. No.: 350,048

[22] Filed: Feb. 18, 1982

[30] Foreign Application Priority Data

Mar. 2, 1981 [JP] Japan ..... 56-29678

[51] Int. Cl.[3] ..... C22C 19/05

[52] U.S. Cl. ..... 420/443

[58] Field of Search ..... 420/443, 455; 148/410, 148/427, 428

[56] References Cited

U.S. PATENT DOCUMENTS 4,227,925 10/1980 Hosoi et al. ..... 420/443

*Primary Examiner*—R. Dean

*Attorney, Agent, or Firm*—Frishauf, Holtz, Goodman & Woodward

[57] ABSTRACT

A heat resistant nickel base alloy which is excellent in not only hot and cold workability but also high temperature strength properties and which also possesses satisfactory oxidation resistance. The nickel base alloy consists essentially of 0.001–0.15 percent carbon, 0.0005–0.05 percent calcium, 20.0–126.0 percent chromium, 4.7–9.4 percent cobalt, 5.0–16.0 percent molybdenum, 0.5–4.0 percent tungsten, with the total of molybdenum plus tungsten being from 9.0 to 16.5 percent, and the balance nickel and inevitable impurities. The alloy may further contain one selected from the group consisting of (1) 0.3–1.5 percent aluminum and 0.1–1.0 percent titanium, (2) 0.001–0.30 percent at least one of yttrium and rare earth elements, and (3) 0.01–1.0 percent at least one of niobium, vanadium and tantalum, whereby the aforementioned characteristics are further enhanced.

36 Claims, No Drawings

HEAT RESISTANT NICKEL BASE ALLOY EXCELLENT IN WORKABILITY AND HIGH TEMPERATURE STRENGTH PROPERTIES

BACKGROUND OF THE INVENTION

This invention relates to heat resistant nickel base alloys, and more particularly to heat resistant nickel base alloys of the solid solution strengthening type which are excellent in hot workability and cold workability as well as tensile strength and fatigue strength at high temperatures and also possess satisfactory oxidation resistance.

Conventionally, heat resistant nickel base alloys such as Hastelloy X have fairly long been used as component parts of various high-temperature apparatuses for prime movers including gas turbine combustors, and also as component parts of various high-temperature apparatuses for use in the chemical industry and the nuclear energy industry, etc. In recent years there have been desired new materials which can withstand use as component parts of the above various high-temperature apparatuses under severer conditions. In order to meet such demand, various heat resistant alloys have been developed and actually used under the name of superalloys. On the other hand, nowadays the aforementioned high-temperature apparatuses trend toward higher efficiency. To respond to this trend, more rigorous requirements are generally imposed upon materials for these high-temperature apparatuses in respect of oxidation resistance, high temperature strength, high temperature flexural fatigue strength, hot workability, cold workability, etc. However, it is a general tendency in designing such alloys that the improvements in the high temperature strength and the high temperature flexural fatique strength are incompatible with those in the hot workability and the cold workability. For instance, excellent hot workability and cold workability are given by Ni-Cr-Mo-Fe alloys represented by Hastelloy X, and Ni-Cr-Mo-Co alloys, which are heat resistant nickel base alloys of the solid solution strengthening type and conventionally used as nickel base super alloys. Therefore, these conventional alloys can be satisfactorily wrought. However, these alloys generally do not fully satisfy recent higher requirements in respect of high temperature characteristics such as high temperature strength and high temperature flexural fatigue strength.

OBJECT AND SUMMARY OF THE INVENTION

It is therefore the object of the invention to provide heat resistant nickel base alloys of the solid solution strengthening type which are excellent in all of hot workability and cold workability, high temperature tensile strength and high temperature fatigue strength, as well as oxidation resistance, thereby being fully suited for use as component parts of various high-temperature apparatuses.

The present invention provides a heat resistant nickel base alloy which consists essentially of carbon from 0.001 to 0.15 percent, calcium from 0.0005 to 0.05 percent, chromium from 20.0 to 26.0 percent, preferably from 20.0 to 24.0 percent, cobalt from 4.7 to 9.4 percent, preferably from 6.5 to 9.4 percent, molybdenum from 5.0 to 16.0 percent, preferably from 8.0 to 10.0 percent, tungsten from 0.5 to 4.0 percent, with the total of molybdenum plus tungsten being from 9.0 to 16.5 percent, preferably from 10.0 to 13.5 percent, and the balance nickel and inevitable impurities.

If required, the nickel base alloys of the present invention may further contain an element or elements in at least one of the following items:

(1) aluminum from 0.3 to 1.5 percent, perferably from 0.6 to 1.5 percent, and titanium from 0.1 to 1.0 percent;

(2) a material selected from the group consisting of yttrium, rare earth elements and mixtures thereof from 0.001 to 0.30 percent; and (3) a material selected from the group consisting of niobium, vanadium, tantalum and mixtures thereof from 0.01 to 1.0 percent.

DETAILED DESCRIPTION

Under the aforementioned circumstances, the present applicants have made many studies in order to obtain heat resistant nickel base alloys which are markedly excellent in hot workabililty, cold workability and oxidation resistance and in particular also exhibit fully satisfactory tensile strength and fatigue strength at high temperatures. As a result, the applicants have reached the following findings:

(a) Although it is generally employed to add molybdenum and tungsten to Ni-Cr alloys for the purpose of enhancing the high temperature strength properties of such alloys, the addition of molybdenum and tungsten may often spoil the cold workability, making it difficult to form alloy blanks into complicated shapes, since it also increases the room temperature strength of the alloys. However, when molybdenum and tungsten are added dually so as to keep the content of each of them and the total content of them within respective particular ranges, the high temperature strength properties of the above Ni-Cr alloys can further be enhanced with no appreciable degradation in the cold workability. The effect of the dual addition is greater rather than that of molybdenum single addition.

(b) Addition of calcium to Ni-Cr alloys improves the high temperature strength properties and hot workability and in particular raises the allowable upper limits of the molybdenum and tungsten contents: they were conventionally difficult to raise owing to expected spoilage of the cold workability.

(c) Addition of cobalt in appropriate amounts to Ni-Cr alloys containing molybdenum and tungsten can further improve the high temperature strength properties without degradation in the cold workability.

(d) If aluminum and titanium are also added to Ni-Cr alloys containing molybdenum, tungsten and calcium, a fine intermetallic compound $Ni_3$ (Al, Ti) evenly and dispersively precipitates in the matrix which further enhances the high temperature strength properties.

(e) Further, addition of yttrium and/or rare earth elements such as cerium and lathanum to the Ni-Cr alloys referred to in the preceding paragraphs (a)–(d) further improves the oxidation resistance and hot workability of the alloys.

(f) If at least one of niobium, vanadium and tantalum is added to the Ni-Cr alloys referred to in the preceding paragraphs (a)–(e), the added niobium, vanadium and/or tantalum reacts with the carbon in the alloys to cause a precipitation of carbides in the matrix and makes finer the crystal grains obtained after recrystallization, thus enhancing the flexural fatigue strength at high temperatures.

The present invention is based upon the above findings. The nickel base alloys according to the invention have the aforestated chemical compositions. Throughout the present specification percentages of the components are weight percentages.

The contents of the component elements of the nickel base alloys of the present invention are limited as previously mentioned for the following reasons:

(a) Carbon:

Carbon is contained in the alloys of the invention in an amount from 0.001 to 0.15 percent. The carbon acts as a deoxidizer in an alloy melt. To ensure deoxidizing action, the lower limit of the carbon still present in the resulting alloy must be at least 0.001 percent. However, if the carbon content exceeds 0.1 percent, there will exist in the alloy excessive amounts of carbides formed by reaction with molybdenum and tungsten which act to strengthen the solid solution, resulting in spoilage of the high temperature strength properties of the alloy. Therefore, the carbon content has been limited to a range from 0.001 to 0.15 percent.

(b) Calcium:

Calcium is contained in the alloys of the invention in an amount from 0.0005 to 0.05 percent. The calcium contributes to improvement in the hot workability, cold workability, high temperature tensile strength and high temperature fatigue strength of the alloys. If contained in less than 0.0005 percent, it cannot fully perform its proper action, whereas in excess of 0.05 percent, the resulting alloy has markedly poor hot workability. Therefore, the calcium content has been limited to a range from 0.0005 to 0.05 percent.

(c) Chromium:

Chromium is contained in the alloys of the invention in an amount from 20.0 to 26.0 percent, preferably from 20.0 to 24.0 percent. The chromium acts to form strong oxide films over the alloys at high temperatures, thus enhancing the oxidation resistance of the alloys. If the chromium content is less than 20.0 percent, chromium cannot perform a desired oxide film-forming action. Whilst, in excess of 26.0 percent, there will occur a degradation particularly in the high temperature strength properties of the alloys. Therefore, the chromium content has been limited to a range from 20.0 to 26.0 percent. To ensure high grades of high temperature strength properties, the upper limit of the chromium content should desirably be 24.0 percent.

(d) Cobalt:

The alloys of the invention contain cobalt in an amount from 4.7 to 9.4 percent, preferably from 6.5 to 9.4 percent. The cobalt acts to enhance the high temperature strength properties of the alloys. If contained in less than 4.7 percent, desired strength-enhancing results cannot be obtained. On the other hand, if contained in excess of 9.4 percent, the resulting alloy has room temperature strength which is too high, remarkably deteriorating the cold workability of the alloys. Thus, the cobalt content has been limited to a range from 4.7 to 9.4 percent. Best high temperature strength properties are available if the cobalt content is within a range from 6.5 to 9.4 percent.

(e) Molybdenum and tungsten:

The alloys of the invention contain molybdenum in an amount from 5.0 to 16.0 percent, preferably from 8.0 to 10.0 percent, and tungsten in an amount from 0.5 to 4.0 percent. The molybdenum and tungsten act as main elements for enhancing the high temperature strength properties of the alloys, and particularly tungsten outstandingly improves the flexural fatigue strength. If molybdenum and tungsten are contained in less than 5.0 percent and less than 0.5 percent, respectively, appreciable improvements in the high temperature strength properties cannot be obtained. Particularly, with the tungsten content less than 0.5 percent, the flexural fatigue strength cannot be remarkably improved. On the other hand, if molybdenum and tungsten are contained in more than 16.0 percent and more than 4.0 percent, respectively, there occurs a large degradation in the cold workability of the alloys. However, with the molybdenum and tungsten contents within respective certain ranges, combined addition of these two elements is more effective to maintain excellent high temperature strength properties as well as a certain grade of cold workability, rather than addition of only one of molybdenum and tungsten. More specifically, even when the molybdenum content is within the range from 5.0 to 16.0 percent and the tungsten content is within the range from 0.5 to 4.0 percent, the high temperature strength-enhancing action cannot bring about desired results if the total of molybdenum plus tungsten is less than 9.0 percent. On the other hand, a total of molybdenum plus tungsten in excess of 16.5 percent will result in a noticeable degradation in the cold workability of the alloys. Therefore, the molybdenum content must be from 5.0 to 16.5 percent and the tungsten content from 0.5 to 4.0 percent, respectively, with the total of molybdenum plus tungsten being from 9.0 to 16.5 percent. Best high temperature strength properties are obtained when molybdenum and tungsten are contained in amounts from 8.0 to 10.0 percent and from 0.5 to 4.0 percent, respectively, with the total content of molybdenum and tungsten being from 10.0 to 13.5 percent.

(f) Aluminum and titanium:

The alloys of the invention may further contain aluminum in an amount from 0.3 to 1.5 percent, preferably from 0.6 to 1.5 percent, and titanium from 0.1 to 1.0 percent, respectively. The aluminum and titanium become combined with the nickel to form a fine intermetallic compound which is evenly dispersed in the matrix, further enhancing the high temperature strength properties. With the aluminum and titanium contents less than 0.3 percent and less than 0.1 percent, respectively, these elements are not effective to remarkably improve the high temperature strength properties. Whilsts, if contained in more than 1.5 percent and more than 1.0 percent, respectively, they can greatly spoil the cold workability and even cause brittleness in the resulting alloy. This is why the aluminum content and the titanium content have been limited, respectively, to ranges from 0.3 to 1.5 percent and 0.1 to 1.0 percent. If the alloy contains aluminum in an amount from 0.6 to 1.5 percent and titanium from 0.1 to 1.0 percent at the same time, best high temperature strength properties are obtained.

(g) Yttrium and rare earth elements:

One or both of yttrium and rare earth elements may further be contained in the alloys of the invention in a total amount from 0.001 to 0.30 percent. The yttrium and rare earth elements equally act to further enhance the oxidation resistance and hot workabilty of the alloys. If their total content is less than 0.001 percent, these elements cannot perform the above action to a desired extent, whereas if contained in excess of 0.30 percent, they cause a degradation in the hot workability. Thus, their total content has been limited to a range from 0.001 to 0.30 percent.

(h) Niobium, vanadium and tantalum:

The alloys of the invention may further contain at least one of niobium, vanadium and tantalum in a total amount from 0.01 to 1.0 percent. The niobium, vanadium and tantalum react with the carbon to form a carbide or carbides which precipitate in the matrix, and make finer the crystal grains formed in the recrystallization of the alloy, thus further enhancing the flexural fatique strength at high temperatures in particular. If their total content is less than 0.01 percent, these elements cannot satisfactorily perform the above action. Whilst, in excess of 1.0 percent, there occurs a noticeable degradation in the oxidation resistance. Thus, their total content has been limited to a range from 0.01 to 1.0 percent.

EXAMPLE

The alloys Nos. 1–53 according to the present invention, Nos. 54–65 and Hastelloy X for comparison, the chemical compositions of which are given in Table 1, were cast into ingots having a diameter of approximately 60 mm and a height of 200 mm. Then, these ingots were subjected to hot forging. The resulting forgings were hot rolled into plates having a thickness of 4 mm, except those which had cracks formed therein during the above hot forging. The hot rolled plates were then cold rolled into sheets, followed by finally subjecting the sheets to solution heat treatment at temperatures from 1150° to 1200° C. for 20 minutes and then water quenched so as to have the grain size adjusted to a size approximately equal to a grain size number of 6 according to ASTM.

Then, to evaluate the cold warkability of the above alloys, a tight bendng test was conducted on the alloys, using specimens having a size of 2 mm in thickness, 20 mm in width and approximately 150 mm in length under the following conditions:

Testing Temperature: Room temperature
Bending Factor: 0
Bending Angle: 180 degrees

| | Chemical Composition (weight %) | | | | | | | | | | | | | | |
|---|---|---|---|---|---|---|---|---|---|---|---|---|---|---|---|
| Alloy | C | Ca | Cr | Co | Mo | W | Y | Rare Earth Elements | Nb | V | Ta | Al | Ti | Ni + Inev. Impurities | (Mo + W) |
| Alloys of the Present Invention | | | | | | | | | | | | | | | |
| 1 | 0.0012 | 0.012 | 21.8 | 8.01 | 9.01 | 3.31 | — | — | — | — | — | — | — | bal. | 12.41 |
| 2 | 0.08 | 0.014 | 21.4 | 8.05 | 8.90 | 3.25 | — | — | — | — | — | — | — | bal. | 12.51 |
| 3 | 0.148 | 0.015 | 21.6 | 8.02 | 9.00 | 3.18 | — | — | — | — | — | — | — | bal. | 12.18 |
| 4 | 0.08 | 0.00054 | 21.8 | 8.09 | 8.94 | 3.05 | — | — | — | — | — | — | — | bal. | 11.99 |
| 5 | 0.07 | 0.048 | 21.4 | 7.98 | 9.03 | 3.08 | — | — | — | — | — | — | — | bal. | 12.11 |
| 6 | 0.06 | 0.008 | 20.5 | 7.88 | 9.11 | 3.04 | — | — | — | — | — | — | — | bal. | 12.15 |
| 7 | 0.08 | 0.009 | 25.9 | 7.91 | 9.08 | 3.01 | — | — | — | — | — | — | — | bal. | 12.09 |
| 8 | 0.07 | 0.010 | 22.0 | 4.73 | 9.60 | 1.63 | — | — | — | — | — | — | — | bal. | 11.23 |
| 9 | 0.07 | 0.007 | 22.1 | 9.39 | 9.63 | 1.58 | — | — | — | — | — | — | — | bal. | 11.21 |
| 10 | 0.08 | 0.005 | 22.5 | 8.41 | 5.09 | 3.94 | — | — | — | — | — | — | — | bal. | 9.03 |
| 11 | 0.05 | 0.004 | 22.6 | 8.05 | 15.89 | 0.52 | — | — | — | — | — | — | — | bal. | 16.41 |
| 12 | 0.07 | 0.003 | 22.2 | 8.34 | 9.20 | 0.55 | — | — | — | — | — | — | — | bal. | 9.75 |
| 13 | 0.06 | 0.004 | 22.8 | 8.02 | 11.46 | 3.98 | — | — | — | — | — | — | — | bal. | 15.44 |
| 14 | 0.08 | 0.006 | 21.2 | 8.00 | 9.60 | 1.52 | 0.0012 | — | — | — | — | — | — | bal. | 11.12 |
| 15 | 0.07 | 0.005 | 21.8 | 8.02 | 9.58 | 1.51 | 0.103 | — | — | — | — | — | — | bal. | 11.09 |
| 16 | 0.09 | 0.004 | 22.2 | 7.98 | 9.57 | 1.50 | 0.148 | — | — | — | — | — | — | bal. | 11.07 |
| 17 | 0.07 | 0.008 | 22.2 | 7.99 | 9.53 | 1.53 | — | 0.0011 | — | — | — | — | — | bal. | 11.06 |
| 18 | 0.06 | 0.012 | 21.9 | 8.01 | 9.52 | 1.56 | — | 0.113 | — | — | — | — | — | bal. | 11.08 |
| 19 | 0.09 | 0.011 | 21.8 | 8.11 | 9.56 | 1.51 | — | 0.147 | — | — | — | — | — | bal. | 11.07 |
| 20 | 0.08 | 0.011 | 22.0 | 8.11 | 9.52 | 1.49 | 0.063 | 0.042 | — | — | — | — | — | bal. | 11.01 |
| 21 | 0.06 | 0.011 | 22.0 | 7.96 | 7.86 | 2.81 | — | — | 0.014 | — | — | — | — | bal. | 10.67 |
| 22 | 0.08 | 0.005 | 21.8 | 8.04 | 7.84 | 2.75 | — | — | 0.91 | — | — | — | — | bal. | 10.59 |
| 23 | 0.08 | 0.008 | 21.9 | 8.02 | 7.75 | 2.80 | — | — | — | 0.013 | — | — | — | bal. | 10.55 |
| 24 | 0.07 | 0.008 | 21.9 | 7.96 | 7.68 | 2.90 | — | — | — | 0.94 | — | — | — | bal. | 10.58 |
| 25 | 0.06 | 0.005 | 22.2 | 7.96 | 7.84 | 2.72 | — | — | — | — | 0.012 | — | — | bal. | 10.56 |
| 26 | 0.07 | 0.008 | 22.8 | 8.02 | 7.77 | 2.82 | — | — | — | — | 0.95 | — | — | bal. | 10.59 |
| 27 | 0.07 | 0.008 | 22.4 | 8.04 | 7.68 | 2.82 | — | — | 0.45 | 0.16 | — | — | — | bal. | 10.50 |
| 28 | 0.07 | 0.005 | 22.0 | 8.04 | 7.62 | 2.86 | — | — | — | 0.19 | 0.35 | — | — | bal. | 10.48 |
| 29 | 0.06 | 0.008 | 22.0 | 7.96 | 7.81 | 2.74 | 0.051 | — | 0.42 | — | — | — | — | bal. | 10.55 |
| 30 | 0.08 | 0.005 | 21.8 | 7.96 | 7.63 | 2.74 | 0.023 | 0.017 | 0.15 | 0.13 | 0.40 | — | — | bal. | 10.37 |
| 31 | 0.07 | 0.010 | 22.3 | 8.30 | 9.38 | 3.20 | — | — | — | — | — | 0.35 | 0.30 | bal. | 12.58 |
| 32 | 0.08 | 0.008 | 22.0 | 8.28 | 9.44 | 3.25 | — | — | — | — | — | 0.63 | 0.33 | bal. | 12.69 |
| 33 | 0.08 | 0.005 | 22.1 | 8.24 | 9.55 | 3.31 | — | — | — | — | — | 1.08 | 0.24 | bal. | 12.86 |
| 34 | 0.07 | 0.005 | 22.1 | 8.26 | 9.28 | 3.20 | — | — | — | — | — | 1.42 | 0.15 | bal. | 12.48 |
| 35 | 0.07 | 0.010 | 22.1 | 8.21 | 9.18 | 3.11 | — | — | — | — | — | 0.92 | 0.62 | bal. | 12.29 |
| 36 | 0.07 | 0.008 | 22.3 | 8.28 | 9.20 | 3.01 | — | — | — | — | — | 0.95 | 0.95 | bal. | 12.21 |
| 37 | 0.12 | 0.00052 | 20.5 | 9.44 | 6.09 | 3.80 | — | — | — | — | — | 1.20 | 0.45 | bal. | 9.89 |
| 38 | 0.002 | 0.035 | 25.7 | 4.90 | 13.32 | 3.06 | — | — | — | — | — | 1.15 | 0.35 | bal. | 16.38 |
| 39 | 0.08 | 0.007 | 22.3 | 8.00 | 9.62 | 1.53 | — | — | — | — | — | 0.98 | 0.38 | bal. | 11.15 |
| 40 | 0.08 | 0.005 | 21.9 | 8.45 | 15.58 | 0.61 | — | — | — | — | — | 1.10 | 0.32 | bal. | 16.19 |
| 41 | 0.07 | 0.004 | 22.1 | 8.11 | 7.51 | 3.31 | — | — | — | — | — | 0.72 | 0.22 | bal. | 10.82 |
| 42 | 0.08 | 0.008 | 21.8 | 8.20 | 8.32 | 3.32 | — | — | — | — | — | 0.89 | 0.35 | bal. | 11.64 |
| 43 | 0.07 | 0.004 | 22.0 | 8.18 | 10.40 | 3.22 | — | — | — | — | — | 0.67 | 0.20 | bal. | 13.62 |
| 44 | 0.06 | 0.011 | 24.4 | 8.02 | 9.05 | 3.01 | — | — | — | — | — | 0.90 | 0.33 | bal. | 12.06 |
| 45 | 0.07 | 0.010 | 21.9 | 6.08 | 9.12 | 3.11 | — | — | — | — | — | 0.92 | 0.26 | bal. | 12.22 |
| 46 | 0.07 | 0.007 | 22.2 | 8.20 | 8.24 | 3.35 | 0.023 | — | — | — | — | 0.98 | 0.28 | bal. | 11.59 |
| 47 | 0.06 | 0.008 | 21.8 | 8.23 | 8.90 | 2.88 | — | 0.028 | — | — | — | 1.14 | 0.23 | bal. | 11.78 |
| 48 | 0.06 | 0.010 | 21.9 | 9.00 | 9.23 | 2.00 | 0.015 | 0.013 | — | — | — | 1.07 | 0.30 | bal. | 11.23 |
| 49 | 0.08 | 0.010 | 22.0 | 8.70 | 9.40 | 1.88 | — | — | 0.052 | — | — | 0.98 | 0.34 | bal. | 11.38 |
| 50 | 0.07 | 0.005 | 22.0 | 8.95 | 9.87 | 1.50 | — | — | — | 0.048 | — | 1.14 | 0.35 | bal. | 11.37 |

-continued

| Alloy | Chemical Composition (weight %) | | | | | | | | | | | | | | |
|---|---|---|---|---|---|---|---|---|---|---|---|---|---|---|---|
| | C | Ca | Cr | Co | Mo | W | Y | Rare Earth Elements | Nb | V | Ta | Al | Ti | Ni + Inev. Impurities | (Mo + W) |
| 51 | 0.08 | 0.005 | 22.2 | 8.95 | 10.00 | 1.90 | — | — | — | — | 0.071 | 1.16 | 0.33 | bal. | 11.90 |
| 52 | 0.07 | 0.007 | 21.9 | 8.00 | 8.18 | 3.60 | — | — | 0.03 | 0.02 | 0.03 | 1.16 | 0.31 | bal. | 11.78 |
| 53 | 0.07 | 0.005 | 22.0 | 8.01 | 9.00 | 1.54 | 0.015 | 0.020 | 0.02 | 0.03 | 0.05 | 1.06 | 0.42 | bal. | 10.54 |
| Alloys for Comparison | | | | | | | | | | | | | | | |
| 54 | tr* | 0.018 | 21.7 | 8.03 | 9.04 | 3.21 | — | — | — | — | — | — | — | bal. | 12.25 |
| 55 | 0.18* | 0.021 | 21.8 | 8.02 | 9.00 | 3.17 | — | — | — | — | — | — | — | bal. | 12.17 |
| 56 | 0.09 | —* | 21.8 | 8.00 | 9.01 | 3.05 | — | — | — | — | — | — | — | bal. | 12.06 |
| 57 | 0.08 | 0.056* | 21.9 | 7.94 | 8.88 | 3.09 | — | — | — | — | — | — | — | bal. | 11.97 |
| 58 | 0.07 | 0.009 | 18.1* | 7.94 | 9.03 | 3.00 | — | — | — | — | — | — | — | bal. | 12.03 |
| 59 | 0.08 | 0.007 | 27.3* | 7.98 | 8.92 | 2.98 | — | — | — | — | — | — | — | bal. | 11.90 |
| 60 | 0.09 | 0.009 | 21.9 | 4.20* | 9.54 | 1.58 | — | — | — | — | — | — | — | bal. | 11.12 |
| 61 | 0.09 | 0.009 | 21.8 | 10.10* | 9.60 | 1.61 | — | — | — | — | — | — | — | bal. | 11.21 |
| 62 | 0.07 | 0.008 | 21.7 | 8.02 | 4.65* | 3.95 | — | — | — | — | — | — | — | bal. | 8.60* |
| 63 | 0.08 | 0.007 | 21.9 | 8.01 | 16.93* | 0.52 | — | — | — | — | — | — | — | bal. | 17.45* |
| 64 | 0.10 | 0.009 | 21.9 | 8.02 | 8.58 | 0.43* | — | — | — | — | — | — | — | bal. | 9.01 |
| 65 | 0.09 | 0.004 | 22.0 | 8.06 | 8.79 | 4.35 | — | — | — | — | — | — | — | bal. | 13.14 |
| Hastelloy X | 0.08 | —. | 21.86 | 0.52 | 9.15 | 0.62 | Fe: 7.55 | — | — | — | — | — | — | bal. | 9.77 |

| Alloy | Presence of Cracks | High Temperature Tensile Strength | | | Weight Gain ($g/m^2$) | Numbers to Fracture (cycles) |
|---|---|---|---|---|---|---|
| | | 0.2% Yield Strength ($Kg/mm^2$) | Ultimate Tensile Strength ($Kg/mm^2$) | Elongation (%) | | |
| Alloys for Comparison | | | | | | |
| 1 | nil | 26.5 | 39.1 | 67.8 | 16.1 | $>10^7$ |
| 2 | nil | 26.3 | 38.6 | 75.5 | 16.3 | $>10^7$ |
| 3 | nil | 27.0 | 39.0 | 63.5 | 16.5 | $>10^7$ |
| 4 | nil | 26.2 | 37.4 | 80.1 | 15.2 | $>10^7$ |
| 5 | nil | 26.4 | 38.5 | 50.5 | 16.1 | $>10^7$ |
| 6 | nil | 27.3 | 37.9 | 60.5 | 16.2 | $>10^7$ |
| 7 | nil | 26.4 | 36.5 | 70.3 | 17.8 | $>10^7$ |
| 8 | nil | 26.0 | 36.8 | 80.3 | 16.4 | $>10^7$ |
| 9 | nil | 27.8 | 39.0 | 61.2 | 15.7 | $>10^7$ |
| 10 | nil | 24.2 | 35.9 | 85.4 | 16.5 | $1.5 \times 10^6$ |
| 11 | nil | 28.5 | 39.7 | 60.0 | 14.9 | $>10^7$ |
| 12 | nil | 25.1 | 35.0 | 81.5 | 15.8 | $3.8 \times 10^6$ |
| 13 | nil | 28.1 | 39.0 | 58.1 | 16.7 | $>10^7$ |
| 14 | nil | 25.8 | 37.2 | 60.0 | 17.0 | $>10^7$ |
| 15 | nil | 26.8 | 38.1 | 68.5 | 13.4 | $>10^7$ |
| 16 | nil | 27.0 | 38.2 | 50.8 | 14.5 | $>10^7$ |
| 17 | nil | 27.1 | 38.4 | 70.3 | 16.3 | $>10^7$ |
| 18 | nil | 26.9 | 37.7 | 65.9 | 12.8 | $>10^7$ |
| 19 | nil | 25.8 | 36.5 | 53.3 | 13.9 | $>10^7$ |
| 20 | nil | 26.2 | 37.0 | 54.5 | 14.1 | $>10^7$ |
| 21 | nil | 25.1 | 37.3 | 66.5 | 15.2 | $>10^7$ |

| Alloy | Presence of Cracks | High Temperature Strength Properties | | | Weight Gain ($g/m^2$) | Numbers to Fracture (cycles) |
|---|---|---|---|---|---|---|
| | | 0.2% Yield Strength ($Kg/mm^2$) | Ultimate Tensile Strength ($Kg/mm^2$) | Elongation (%) | | |
| Alloys for Comparison | | | | | | |
| 22 | nil | 26.9 | 38.5 | 61.3 | 17.9 | $>10^7$ |
| 23 | nil | 25.4 | 37.2 | 71.5 | 15.3 | $>10^7$ |
| 24 | nil | 26.7 | 38.8 | 62.2 | 17.0 | $>10^7$ |
| 25 | nil | 25.8 | 36.4 | 75.1 | 15.5 | $>10^7$ |
| 26 | nil | 26.5 | 38.2 | 60.5 | 16.8 | $>10^7$ |
| 27 | nil | 26.7 | 37.8 | 59.8 | 16.9 | $>10^7$ |
| 28 | nil | 26.3 | 37.5 | 60.7 | 17.4 | $>10^7$ |
| 29 | nil | 26.4 | 37.2 | 63.4 | 14.8 | $>10^7$ |
| 30 | nil | 26.6 | 37.7 | 80.8 | 15.1 | $>10^7$ |
| 31 | nil | 30.1 | 40.1 | 80.4 | 15.4 | $>10^7$ |
| 32 | nil | 32.3 | 42.1 | 100.5 | 15.6 | $>10^7$ |
| 33 | nil | 33.8 | 42.2 | 108.1 | 15.8 | $>10^7$ |
| 34 | nil | 33.3 | 43.0 | 70.2 | 15.2 | $>10^7$ |
| 35 | nil | 32.5 | 42.1 | 105.1 | 16.1 | $>10^7$ |
| 36 | nil | 32.8 | 43.1 | 74.3 | 15.0 | $>10^7$ |
| 37 | nil | 28.5 | 40.2 | 120.1 | 16.7 | $6.5 \times 10^6$ |

-continued

| | | | | | | |
|---|---|---|---|---|---|---|
| 38 | nil | 33.9 | 42.3 | 48.3 | 14.3 | $>10^7$ |
| 39 | nil | 29.2 | 40.5 | 109.8 | 16.3 | $>10^7$ |
| 40 | nil | 34.1 | 43.3 | 50.0 | 15.9 | $>10^7$ |

| | | High Temperature Tensile Strength | | | | |
|---|---|---|---|---|---|---|
| Alloy | Presence of Cracks | 0.2% Yield Strength ($Kg/mm^2$) | Ultimate Tensile Strength ($Kg/mm^2$) | Elongation (%) | Weight Gain ($g/m^2$) | Numbers to Fracture (cycles) |
| Alloys of the Present Invention | | | | | | |
| 41 | nil | 29.9 | 39.1 | 110.1 | 16.0 | $9.1 \times 10^6$ |
| 42 | nil | 32.3 | 42.9 | 102.3 | 15.3 | $>10^7$ |
| 43 | nil | 32.8 | 42.5 | 51.1 | 16.4 | $>10^7$ |
| 44 | nil | 29.0 | 38.9 | 103.8 | 16.8 | $5.8 \times 10^6$ |
| 45 | nil | 29.2 | 39.0 | 62.8 | 15.9 | $6.2 \times 10^6$ |
| 46 | nil | 31.3 | 41.6 | 85.5 | 13.5 | $>10^7$ |
| 47 | nil | 31.5 | 41.8 | 87.4 | 14.1 | $>10^7$ |
| 48 | nil | 30.5 | 40.8 | 115.5 | 13.9 | $>10^7$ |
| 49 | nil | 30.9 | 41.3 | 79.5 | 15.3 | $>10^7$ |
| 50 | nil | 31.3 | 41.0 | 75.4 | 16.1 | $>10^7$ |
| 51 | nil | 31.8 | 41.5 | 72.3 | 15.8 | $>10^7$ |
| 52 | nil | 32.0 | 42.1 | 79.9 | 16.5 | $>10^7$ |
| 53 | nil | 30.0 | 40.8 | 108.3 | 15.0 | $>10^7$ |
| Alloys for Comparison | | | | | | |
| 54 | Cracks occurred at hot forging. | | | | | |
| 55 | present | — | — | — | — | — |
| 56 | present | — | — | — | — | — |
| 57 | Cracks occurred at hot forging. | | | | | |
| 58 | nil | 27.0 | 36.9 | 70.3 | 21.3 | $8.9 \times 10^6$ |
| 59 | nil | 21.3 | 34.8 | 40.3 | 18.0 | $8.3 \times 10^5$ |
| 60 | nil | 20.4 | 33.8 | 80.5 | 15.8 | $7.7 \times 10^5$ |
| 61 | present | — | — | — | — | — |
| 62 | nil | 21.1 | 33.1 | 85.1 | 15.3 | $9.1 \times 10^5$ |
| 63 | present | — | — | — | — | — |
| 64 | nil | 23.1 | 34.8 | 54.8 | 16.1 | $6.1 \times 10^5$ |
| 65 | present | — | — | — | — | — |
| Hastelloy X | nil | 22.2 | 35.2 | 45.8 | 20.1 | $8.4 \times 10^5$ |

Presence of cracks in the specimens after the tight bending was examined. Those specimens which had no cracks formed therein were subjected to a high temperature tensile strength test, an oxidation resistance test and a flexural bending test (fatigue test). The high temperature tensile strength test was conducted at 800° C. according to ASTM E-21, using specimens having a size corresponding to the sub size according to ASTM E-8. In the oxidation resistance rest, specimens having a size of 2 mm in thickness, 20 mm in width and 30 mm in length were heated at 950° C. for 300 hours in an ordinary electric furnace. The flexural bending test was conducted under the following conditions, using specimens which have a size of 2 mm in thickness and 20 mm in width at its central bending portion:

Maximum Stress: 38 $kg/mm^2$

Mean Stress: 0

Stress Ratio (R): −1

Testing Temperature: 600° C.

In the above oxidation resistance test, the weight gains of the heated specimens were measured. In the above flexural bending test, the numbers of repeated bending were counted until the specimens became fractured. Results of these tests are shown in Table 2.

It is clearly noted from Table 2 that the comparative alloys Nos. 54–65, which have at least one of the components contained in an amount falling outside the range of the present invention, whose content value is asterisked in the table, are inferior to the Hastelloy X in at least one of cold workability, high temperature tensile strength, oxidation resistance, and high temperature flexural fatigue strength, whereas the alloys Nos. 1–53 according to the present invention show equivalent cold workability to the Hastelloy X but show characteristics much superior to the latter in respect of high temperature tensile strength, oxidation resistnce, and high temperature flexural fatigue strength.

As set forth above, the heat resistant nickel base alloys according to the present invention possess excellent characteristics in all of high temperature strength properties, hot workability, cold workability, and oxidation resistance, and are therefore fully suited for use as component parts of various high temperature apparatuses for prime movers, including gas turbine combustors, which parts are manufactured through working into complicated shapes and required to show excellent characteristics in respect of high temperature strength properties and flexural fatigue strength as well as oxidation resistance.

What is claimed is:

1. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, and the balance nickel and inevitable impurities.

2. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.001 to 0.30 percent a material selected from the group consisting of yttrium, rare earth elements and mixtures thereof, and the balance nickel and inevitable impurities.

3. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.01 to 1.0 percent a material selected from the group consisting of niobium, vanadium, tantalum and mixtures thereof, and the balance nickel and inevitable impurities.

4. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.001 to 0.30 percent a material selected from the group consisting of yttrium, rare earth elements and mixtures thereof, from 0.01 to 1.0 percent a material selected from the group consisting of niobium, vanadium, tantalum and mixtures thereof, and the balance nickel and inevitable impurities.

5. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.3 to 1.5 percent aluminum, from 0.1 to 1.0 percent titanium, and the balance nickel and inevitable impurities.

6. A heat resistant nickel base alloy having excellent hot workability, cold workability and high temperature strength properties consisting essentially of from 0.001 to 0.15 percent carbon, from 0.0005 to 0.05 percent calcium, from 20.0 to 24.0 percent chromium, from 6.5 to 9.4 percent cobalt, from 8.0 to 10.0 percent molybdenum, from 0.5 to 4.0 percent tungsten, with the total of molybdenum plus tungsten being from 10.0 to 13.5 percent, from 0.6 to 1.5 percent aluminum, from 0.1 to 1.0 percent titanium, and the balance nickel and inevitable impurities.

7. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.3 to 1.5 percent aluminum, from 0.1 to 1.0 percent titanium, from 0.001 to 0.30 percent a material selected from the group consisting of yttrium, rare earth elements and mixtures thereof, and the balance nickel and inevitable impurities.

8. A heat resistant nickel base alloy having excellent hot workability, cold workability and high temperature strength properties consisting essentially of from 0.001 to 0.15 percent carbon, from 0.0005 to 0.05 percent calcium, from 20.0 to 24.0 percent chromium, from 6.5 to 9.4 percent cobalt, from 8.0 to 10.0 percent molybdenum, from 0.5 to 4.0 percent tungsten, with the total of molybdenum plus tungsten being from 10.0 to 13.5 percent, from 0.6 to 1.5 percent aluminum, from 0.1 to 1.0 percent titanium, from 0.001 to 0.30 percent a material selected from the group consisting of yttrium, rare earth elements and mixtures thereof, and the balance nickel and inevitable impurities.

9. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.3 to 1.5 percent aluminum, from 0.1 to 1.0 percent titanium, from 0.01 to 1.0 percent a material selected from the group consisting of niobium, vanadium, tantalum and mixtures thereof, and the balance nickel and inevitable impurities.

10. A heat resistant nickel base alloy having excellent hot workability, cold workability and high temperature stength-properties consisting essentially of from 0.001 to 0.15 percent carbon, from 0.0005 to 0.05 percent calcium, from 20.0 to 24.0 percent chromium, from 6.5 to 9.4 percent cobalt, from 8.0 to 10.0 percent molybdenum, from 0.5 to 4.0 percent tungsten, with the total of molybdenum plus tungsten being from 10.0 to 13.5 percent, from 0.6 to 1.5 percent aluminum, from 0.1 to 1.0 percent titanium, from 0.01 to 1.0 percent a material selected from the group consisting of niobium, vanadium, tantalum and mixtures thereof, and the balance nickel and inevitable impurities.

11. A heat resistant nickel base alloy having excellent hot workability, cold workability and high temperature strength properties consisting essentially of from 0.001 to 0.15 percent carbon, from 0.0005 to 0.05 percent calcium, from 20.0 to 26.0 percent chromium, from 4.7 to 9.4 percent cobalt, from 5.0 to 16.0 percent molybdenum, from 0.5 to 4.0 percent tungsten, with the total of molybdenum plus tungsten being from 9.0 to 16.5 percent, from 0.3 to 1.5 percent aluminum, from 0.1 to 1.0 percent titanium, from 0.001 to 0.30 percent a material selected from the group consisting of yttrium rare earth elements and mixtures thereof, from 0.01 to 1.0 percent a material selected from the group consisting of niobium, vanadium, tantalum and mixtures thereof, and the balance nickel and inevitable impurities.

12. A heat resistant nickel base alloy having excellent hot workability, cold workability and high temperature strength properties consisting essentially of from 0.001 to 0.15 percent carbon, from 0.0005 to 0.05 percent calcium, from 20.0 to 24.0 percent chromium, from 6.5 to 9.4 percent cobalt, from 8.0 to 10.0 percent molybdenum, from 0.5 to 4.0 percent tungsten, with the total of molybdenum plus tungsten being from 10.0 to 13.5 percent, from 0.6 to 1.5 percent aluminum, from 0.1 to 1.0 percent titanium, from 0.001 to 0.30 percent a material selected from the group consisting of yttrium, rare earth elements and mixtures thereof, from 0.01 to 1.0 percent a material selected from the group consisting of niobium, vanadium, tantalum and mixtures thereof, and the balance nickel and inevitable impurities.

13. The alloy of claim 1, wherein said tungsten is in an amount not more than 2.98 percent.

14. The alloy of claim 2, wherein said tungsten is in an amount not more than 2.98 percent.

15. The alloy of claim 3, wherein said tungsten is in an amount not more than 2.98 percent.

16. The alloy of claim 4, wherein said tungsten is in an amount not more than 2.98 percent.

17. The alloy of claim 5, wherein said tungsten is in an amount not more than 2.98 percent.

18. The alloy of claim 6, wherein said tungsten is in an amount not more than 2.98 percent.

19. The alloy of claim 7, wherein said tungsten is in an amount not more than 2.98 percent.

20. The alloy of claim 8, wherein said tungsten is in an amount not more than 2.98 percent.

21. The alloy of claim 9, wherein said tungsten is in an amount not more than 2.98 percent.

22. The alloy of claim 10, wherein said tungsten is in an amount not more than 2.98 percent.

23. The alloy of claim 11, wherein said tungsten is in an amount not more than 2.98 percent.

24. The alloy of claim 12, wherein said tungsten is in an amount not more than 2.98 percent.

25. The alloy of claim 1, wherein said molybdenum is in an amount not more than 9.87 percent.

26. The alloy of claim 2, wherein said molybdenum is in an amount not more than 9.87 percent.

27. The alloy of claim 3, wherein said molybdenum is in an amount not more than 9.87 percent.

28. The alloy of claim 4, wherein said molybdenum is in an amount not more than 9.87 percent.

29. The alloy of claim 5, wherein said molybdenum is in an amount not more than 9.87 percent.

30. The alloy of claim 6, wherein said molybdenum is in an amount not more than 9.87 percent.

31. The alloy of claim 7, wherein said molybdenum is in an amount not more than 9.87 percent.

32. The alloy of claim 8, wherein said molybdenum is in an amount not more than 9.87 percent.

33. The alloy of claim 9, wherein said molybdenum is in an amount not more than 9.87 percent.

34. The alloy of claim 10, wherein said molybdenum is in an amount not more than 9.87 percent.

35. The alloy of claim 11, wherein said molybdenum is in an amount not more than 9.87 percent.

36. The alloy of claim 12, wherein said molybdenum is in an amount not more than 9.87 percent.

* * * * *